US005267610A

United States Patent [19]

Culbert

[11] Patent Number: 5,267,610

[45] Date of Patent: Dec. 7, 1993

[54] HEAT EXCHANGER AND MANUFACTURING METHOD

[75] Inventor: Garry R. Culbert, Kuala Lumpur, Malaysia

[73] Assignee: Carrier Corporation, Syracuse, N.Y.

[21] Appl. No.: 973,504

[22] Filed: Nov. 9, 1992

[51] Int. Cl.[5] ..... F28D 1/047; B21D 53/08

[52] U.S. Cl. ..... 165/151; 29/890.047

[58] Field of Search ..... 165/151; 29/890.047

[56] References Cited

U.S. PATENT DOCUMENTS

| | | | |
|---|---|---|---|
| 3,597,956 | 8/1971 | Clausing | 72/305 |
| 3,849,854 | 11/1974 | Mattioli et al. | 29/890.047 X |
| 4,738,014 | 4/1988 | Gray | 29/890.047 |

FOREIGN PATENT DOCUMENTS

| | | | |
|---|---|---|---|
| 63-180089 | 7/1988 | Japan | 165/151 |
| 2-298796 | 12/1990 | Japan | 165/151 |

*Primary Examiner*—Allen J. Flanigan

[57] ABSTRACT

A heat exchanger of the plate fin and tube type and a method for manufacturing such an apparatus. The heat exchanger has a curved face as may be required due to the dimensional constraints of the enclosure housing the heat exchanger. The heat exchanger is constructed with single row plate fins in those portions of the heat exchanger that will experience relative motion between adjacent tube rows during bending of the tubes to achieve the curved face. Multiple row plate fins are used in those portions of the heat exchanger where there will be no relative motion between adjacent tube rows during tube bending. A locking member affixed to one tube row receives an end of a tube in an adjacent row that is more inward, with respect to the center of curvature, during bending and secures the two tube rows together. The use of multiple row plate fins and the locking member produce a strong and rigid assembly.

4 Claims, 6 Drawing Sheets

HEAT EXCHANGER AND MANUFACTURING METHOD

BACKGROUND OF THE INVENTION

This invention relates generally to plate fin and tube heat exchangers and methods for manufacturing heat exchangers of that type. Specifically, the invention relates to a method of manufacturing a plate fin and tube heat exchanger that has multiple rows of tubes and a curved face as well as the heat exchanger so manufactured.

FIGS. 1A, 1B, and 1C provide illustrations to assist in defining terms used in the text of this disclosure. The figures show schematically arrangements of tubes and plate fins that may be encountered in plate fin and tube type heat exchangers. FIG. 1A shows a number of tubes 01 arranged in a single row 02 and passing through stacked fins 03, each of which has a single row of holes to accommodate the single row of tubes. This is the arrangement of tubes and fins in a single row tube, single row plate fin type plate fin and tube heat exchanger. FIG. 1B depicts a number of tubes 01 arranged in two rows 02. Each of plate fins 03 has a single row of holes so that two stacks of plate fins are required for the two rows of tubes. This is the arrangement of tubes and fins in a multiple row tube, single row plate fin type plate fin and tube heat exchanger. FIG. 1C depicts a number of tubes 01 arranged in two rows 02. Each multiple row plate fin 04 has two rows of holes to accommodate the two rows of tubes so that only a single stack of plate fins is required for the two rows of tubes. This is the arrangement of tubes and fins in a multiple row tube, multiple row plate fin type of plate fin and tube heat exchanger.

In manufacturing a typical plate fin and tube heat exchanger, such as may be used in an air conditioning or refrigeration system or in an engine cooling system, U-shaped or hairpin tubes are inserted into holes in the fins and tubesheets until the open ends of the hairpin tubes protrude beyond one of the tubesheets. The walls of the tubes are then expanded radially, using a tube expander, to make firm contact between the fins and the tubes and tubesheets to ensure good heat transfer and structural strength and rigidity. The open ends of the hairpin tube legs are also expanded radially to a greater diameter than the remainder of the tube to form a bell or socket. Short U-tubes, or return bends, nipple connections from a header or a combination of return bends and header nipples are then inserted into the belled ends and secured by a suitable process such as welding, brazing or soldering to form a closed fluid flow path or paths through the heat exchanger. Some plate fin and tube heat exchangers may not use hairpin tubes but are comprised of single tubes each making a single pass through the plate fin stack. This may be the case, for example, when it is desired to have a relatively large number of separate flow paths, or circuits, through the heat exchanger.

The above process works well in manufacturing heat exchangers having but a single row of tubes or heat exchangers that have flat faces, i.e. where the finned region of the tubes remains straight in the completed heat exchanger. Many heat exchanger designs, however, call for multiple rows of tubes in order to achieve sufficient heat transfer area, and thus adequate heat transfer performance, in the heat exchanger within the constraints of overall size limitations. In addition, it is not unusual for other design considerations to call for a heat exchanger having other than a flat face. An example of such a consideration would be where the heat exchanger must have a certain face area, to satisfy heat transfer requirements, yet must fit inside an enclosure that does not have sufficient room to accommodate a flat-faced heat exchanger of the requisite size. In such a situation, it is common to configure the heat exchanger with one or more curves in its face to reduce one or more of its maximum dimensions so as to be able to fit into a given enclosure.

In plate fin and tube heat exchangers having multiple rows of tubes, it is desirable that a single plate fin be configured to have as many of the rows of tubes laced through it as possible. This configuration is desirable not only for ease of assembly but also because using multiple row plate fins prevents relative motion between the rows of tubes and contributes to the rigidity and strength of the completed heat exchanger.

To manufacture a plate fin and tube heat exchanger having a curved face, the tubes must be bent into the desired curved shape. If hairpin tubes are used, the hairpin legs are usually bent in the plane in which the hairpin bend lies rather than in a plane perpendicular to the plane of the bend so that the bend is not distorted and so that the ends of the hairpins remain even.

In a multiple tube row heat exchanger having a curved face, the tubes in a row on the inside of the curve must have a lesser radius of curvature than those on the outside in order for the rows to remain parallel after bending. As a result, a point on one tube that is directly opposite a point on an adjacent tube in a different row before bending will not be opposite that same point after bending. If a curved face multiple tube row heat exchanger were to be constructed by assembling multiple row fins on to tubes, then expanding the tubes and thus fixing the fins to the tubes, then bending the tubes to the desired curve, the relative motion between points on adjacent tubes in different rows would distort and probably tear the fin material along the portion of the tubes that are curved.

One method of preventing distortion of the fins is to bend the tubes before expanding them. Before expansion the fins can be made so that there can be slippage between the tubes and the fins, thus avoiding fin distortion and tearing.

However, the usual method of expanding tubes in a heat exchanger is by driving an expansion tool (known in the industry as a "bullet") attached to the end of a rod through the tube. This method is not suitable for expanding curved tubes. There are methods of expanding a curved tube, such as by forcing a round ball through the curved tube by fluid pressure, but such methods possess serious drawbacks in time required, equipment complexity and scrap rates.

What is needed is a method of making a multiple tube row, curved face plate fin and tube type heat exchanger that allows the use of conventional rod and "bullet" tube expansion machines and yet will produce a heat exchanger with adequate rigidity and strength.

SUMMARY OF THE INVENTION

The present invention is a method of manufacturing a curved face, multiple tube row plate fin and tube heat exchanger and the heat exchanger so manufactured.

In practicing the method, suitable plate fins and either straight single pass tubes or hairpin tubes having straight legs are prepared. Then an end locking member is placed on a tube or tubes in the row that will be toward the outer face of the completed heat exchanger. These tubes are longer than their more inward neighbors because they must bend through a greater radius of curvature during the bending step to follow. Then the plate fins and tubes are assembled so that single row plate fins are located on a certain region or regions of the tubes and multiple row plate fins are located on another region or regions of the tubes. Single row plate fins are located on the tubes where there will be relative motion between points on tubes in adjacent tube rows. Multiple row plate fins are located on the tube where there will be no relative motion between points on tubes in adjacent tube rows. The tubes are then expanded to produce a close fit with the fins. The finned tubes are then bent to produce the desired curvature of the finished heat exchanger. As the tubes bend, the tubes in the inner tube row move relative to the tubes in the outer tube row and an end or ends of a tube in the inner tube row enters a receiving aperture in the locking member affixed to the outer tube row. The locking member then holds the ends of tubes in the inner and outer tube rows in a fixed position relative to each other and prevents relative motion between the two rows. The multiple row plate fins as well as the action of the locking member provide for increased rigidity and strength in the finished heat exchanger.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Note that the drawings illustrate and the following description is of the manufacture of a heat exchanger having hairpin tubes. The method of the invention may also be used to manufacture heat exchangers having single pass tubes, as one skilled in the art will easily comprehend.

Figure 1C:
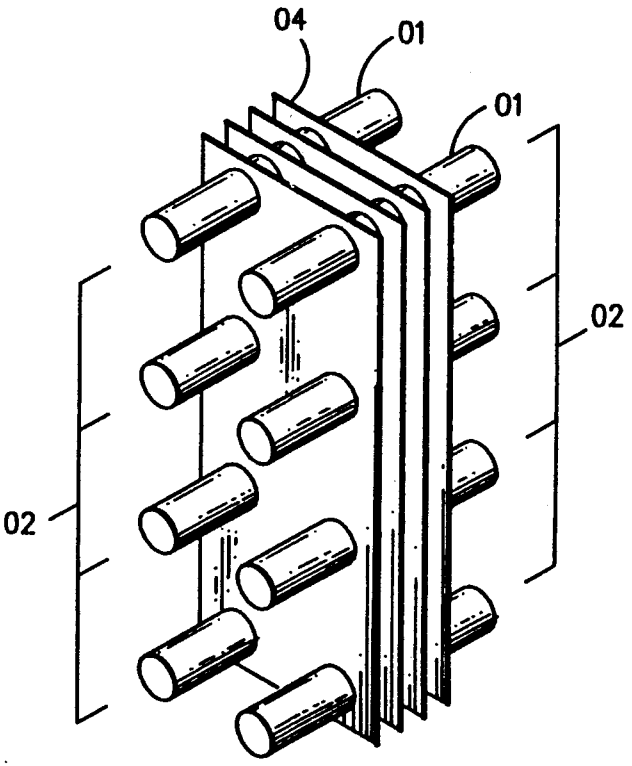
FIGS. 1A, 1B and 1C depict schematically different heat exchanger tube and plate configurations to illustrate the definition of certain terms used in this disclosure.
Figure 1B:
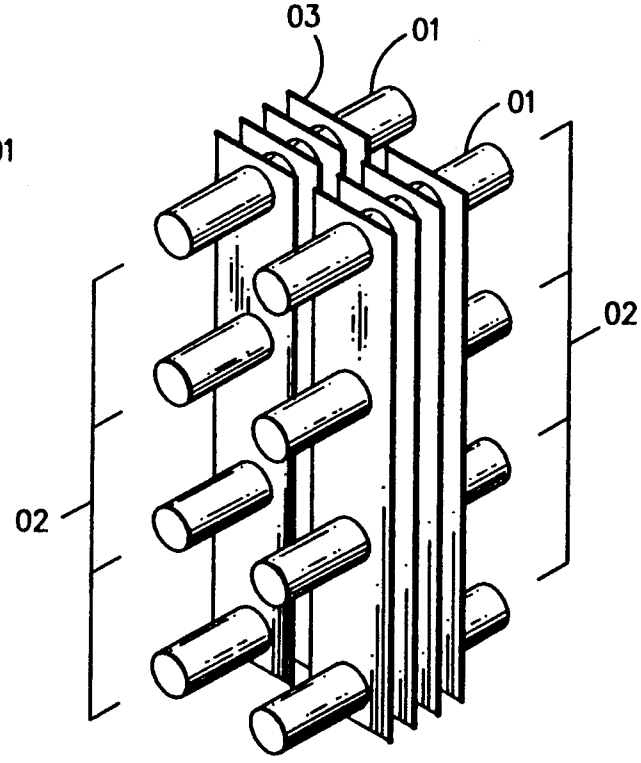
Figure 1A:
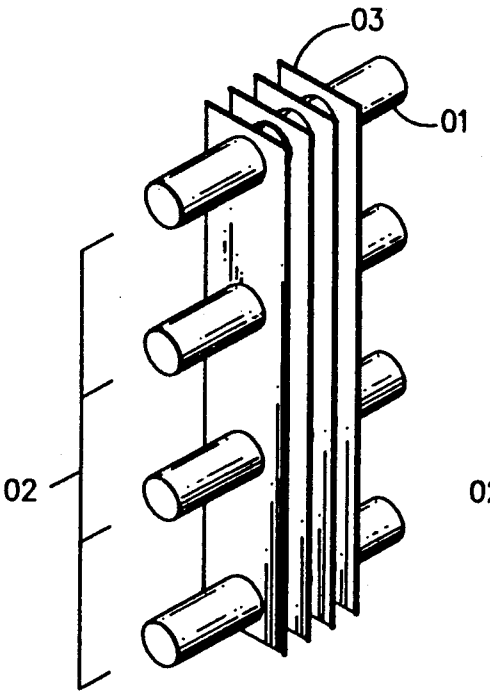
Figure 2:
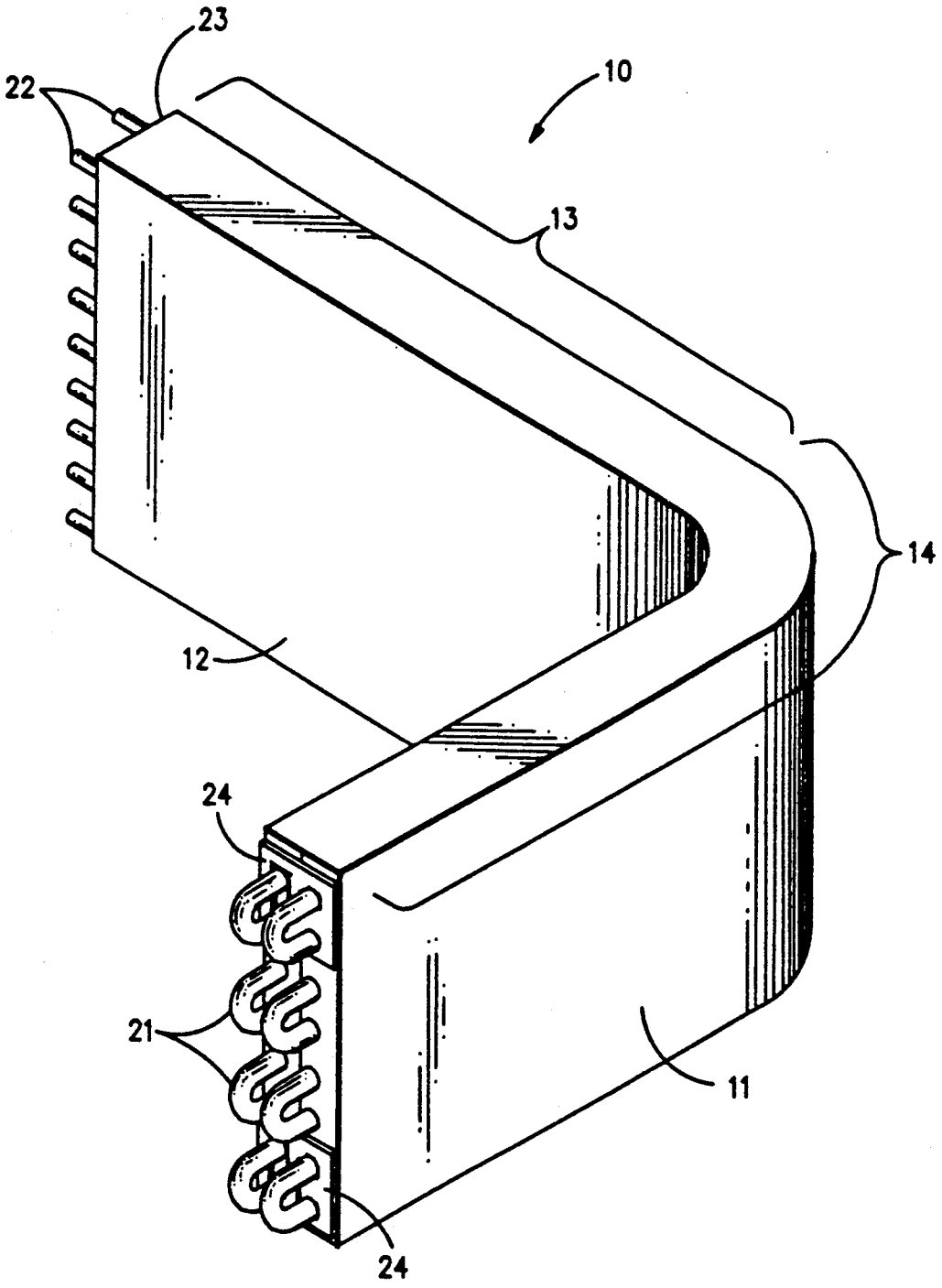
FIG. 2 is an isometric view of a heat exchanger manufactured by the method of the present invention.

FIG. 2 depicts an overall view of a heat exchanger manufactured according to the teaching of the present invention. The figure shows curved plate fin and tube type heat exchanger 10 almost but not completely assembled. Remaining to be done to complete the heat exchanger is to join return bends, header nipples or a combination of return bends and header nipples to open tube ends 22 to form a complete closed fluid flow path or paths through the heat exchanger. Heat exchanger 10 is of the multiple tube row type having outer face 11 and inner face 12. Heat exchanger 10 has both single row and multiple row plate fins on its hairpin tubes. Region 13 of the heat exchanger, which lies between tubesheet 23 and the beginning of the curved portion of the heat exchanger faces contains multiple row fins. The remainder of the finned portion of the heat exchanger, region 14, has single row plate fins. Locking members 24 are located at hairpin bends 21 of the heat exchanger.

Figure 3:
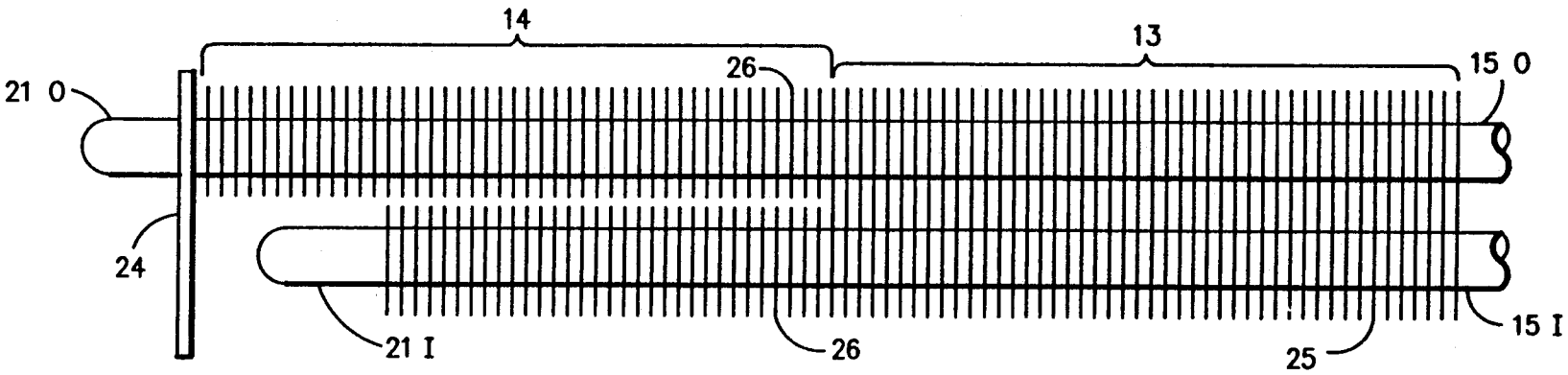
FIG. 3 is a top elevation view of a portion of a heat exchanger at one intermediate stage of manufacture.
Figure 4:
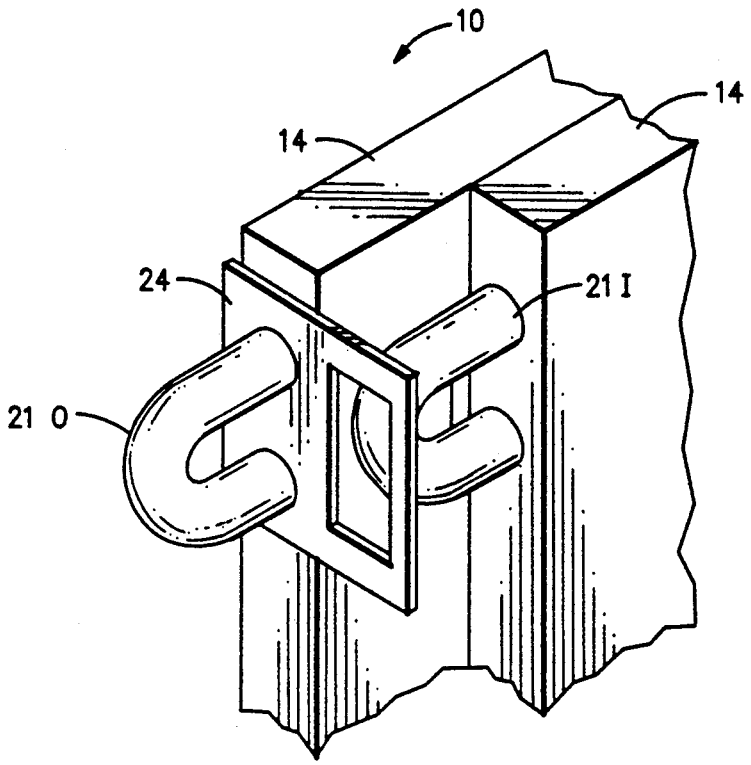
FIG. 4 is an isometric view of a portion of the hairpin bend end of a heat exchanger at the same intermediate stage of manufacture illustrated in FIG. 3.

FIGS. 3 and 4 show respectively a top elevation view and an isometric view of portions of a multiple tube row heat exchanger at a intermediate stage, before the tubes are bent to the desired curvature, of manufacture. Because it is usually desired that, after bending the face of the heat exchanger, the hairpin ends of the tubes in both rows be even and because the radius of curvature of the bends in the tubes in the outer row must be greater than the bends in the tubes in the inner row, the hairpin tubes in the outer row must be longer than the tubes in the inner row. Thus, at this stage, hairpin tube 210, being longer, extends beyond hairpin tube 21I. In assembling the components of the heat exchanger, locking member 24 is first place on the hairpin bend end of tube 210. Then, a separate stack of single row plate fins 26 are located on each of tubes 21O and 21I in region 14, which encompasses the portion of the face of the heat exchanger from the hairpin bend end, through the portion of the face in which there is relative motion between points on tubes in the outer row and points on tubes in the inner row during the tube bending process to the location on the face where region 13, in which there is no relative movement between the tubes during bending, begins. Then, in region 13, a single stack of multiple row plate fins 25 are located on the two tube rows.

Figure 5:
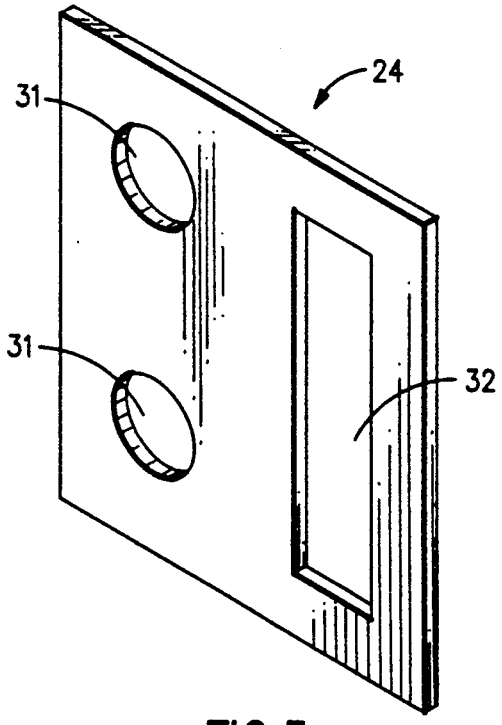
FIG. 5 is an isometric view of a tube locking member used in the heat exchanger of the present invention.

FIG. 5 shows locking member 24 in detail. Member 24 has holes 31 through which the legs of tube 21O are inserted during assembly. Holes 31 are sized such that tubes may be easily inserted during assembly but allow for firm contact between the tubes and member 24 when the tubes are expanded. Locking member 24 also has receiver slot 32, the function of which will be described below.

After locking members and plate fins have been assembled on to the tubes, and while the tube legs are straight, the tubes are expanded, so that there is firm contact between locking members and tubes and plate fins and tubes.

After tube expansion, the tubes are bent so that the face of the heat exchanger takes on the desired curvature.

Figure 6:
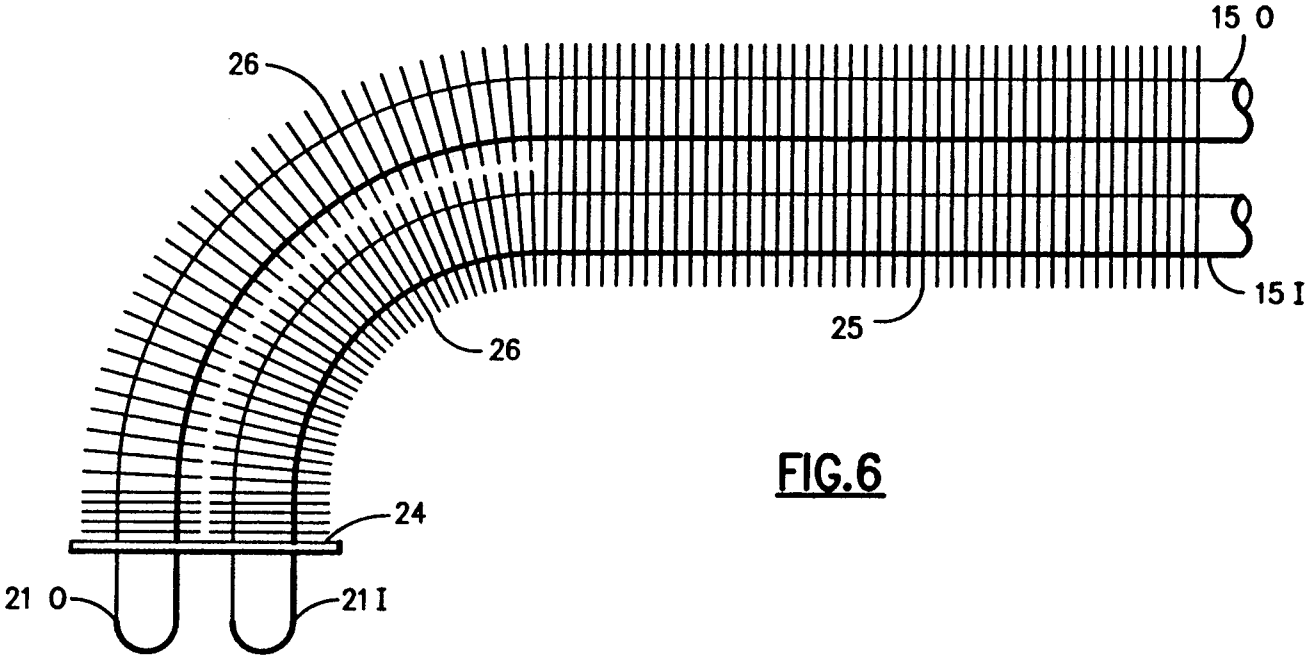
FIG. 6 is a top elevation view of a portion of the hairpin bend end of a completed heat exchanger.
Figure 7:
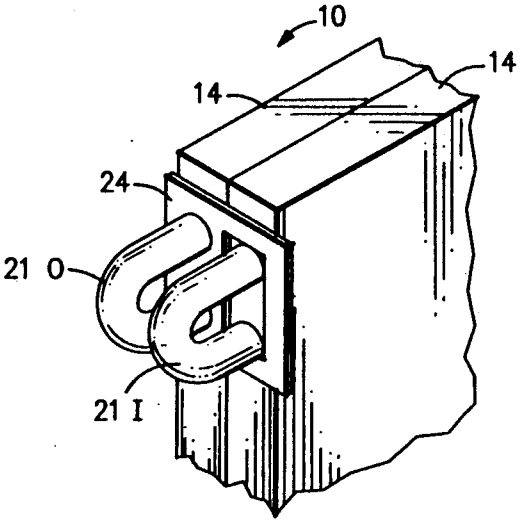
FIG. 7 is an isometric view of a portion of the hairpin bend end of a completed heat exchanger.

FIGS. 6 and 7 show respectively a top elevation view and an isometric view of portions of a multiple tube row heat exchanger after the tubes are bent to the desired curvature. The hairpin bend ends of tubes 210 and 21I are now even. Due to relative motion between the tubes during bending, the hairpin bend end of tube 21I has entered receiver slot 32 (FIG. 5) in locking member 24. Locking member 24 now serves to maintain the inner and outer tube rows of heat exchanger 10 fixed with respect to each other and thus contributes to the strength and rigidity of the finished heat exchanger.

Note that, although single row fins are used in region 14 of heat exchanger 10 (FIG. 2), the drawing shows face 11 to be straight for a significant portion of its length in that region. Nonetheless, single row fins must be used throughout region 14, because there will be relative motion between points on adjacent tube rows throughout that region, even the portion that remains straight after the bending operation.

After bending, the assembly of the heat exchanger is completed by joining return bends and/or header nipples to the ends of the hairpin legs to form closed fluid flow paths through the heat exchanger.

Figure 8:
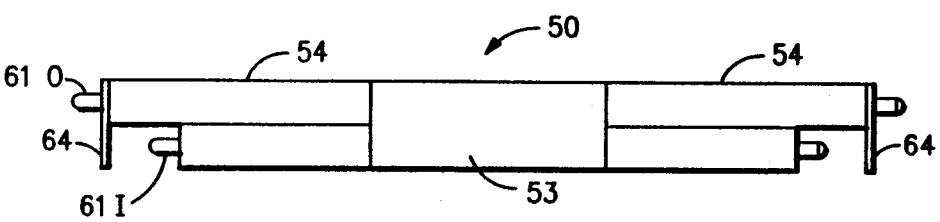
FIGS. 8 and 9 are schematic diagrams of another heat exchanger configuration.
Figure 9:
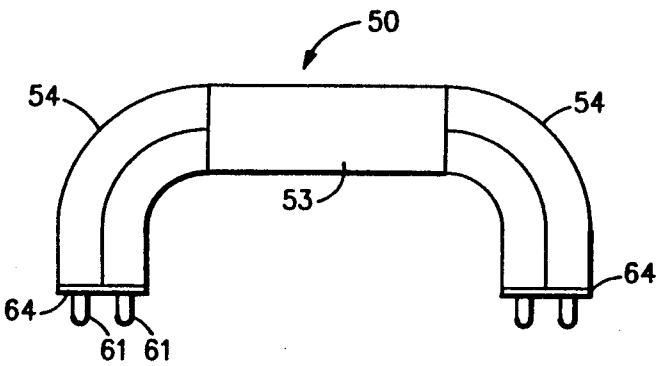

The heat exchanger depicted in FIG. 2 and described above has a configuration like the letter "J" or "L" with a single curve in its face. Other heat exchanger configurations, having more than one curve in a face are possible. FIGS. 8 and 9 depict schematically heat exchanger 50, before and after bending. Heat exchanger 50 has a "C" or "U" shaped face. Multiple row plate fins may be used in that portion 53 of the heat exchanger in which there is no relative motion between points on adjacent tube rows during bending. Single row plate fins are used in those portions 54 of the heat exchanger where there is relative motion during bending. Locking members 64 may be used at both ends of the heat exchanger.

Figure 10:
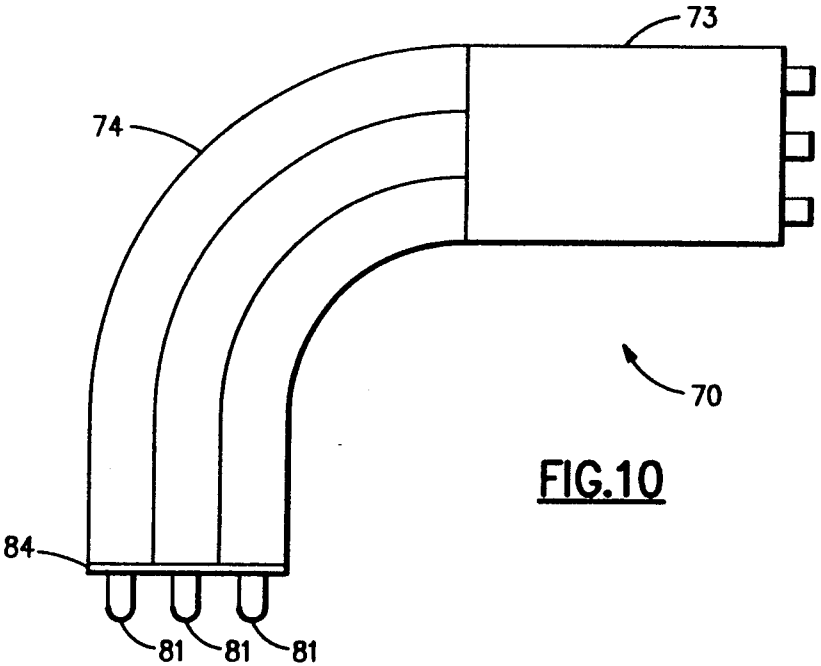
FIG. 10 is a schematic diagram of still another heat exchanger configuration.

A heat exchanger having more than two tube rows is also possible. FIG. 10 depicts schematically another heat exchanger 70, having three rows of tubes, after bending. Where there is relative motion between tube rows when bending, in portion 74, single row plate fins are used. Where there is no relative motion when bending, in portion 73, multiple row plate fins can be used. A suitable locking member 81, or members, fix the ends of hairpin tubes 81 with respect to each other after bending.

Figure 11:
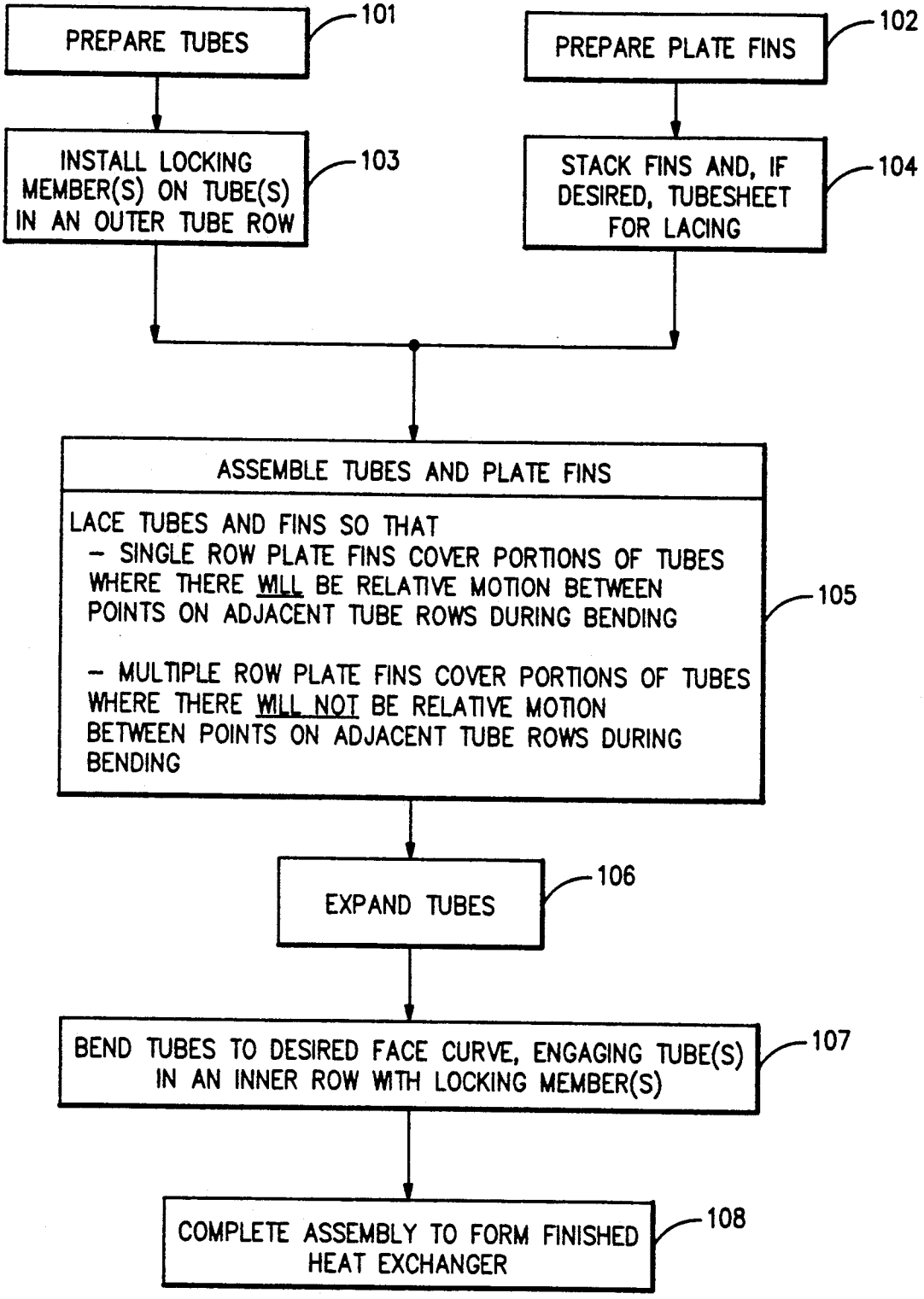
FIG. 11 is a flow or block diagram of the method of the invention.

FIG. 11 shows the method of the invention in a flow or block diagram. In the step indicated in block 101, the tubes for the heat exchanger are prepared for assembly by cutting to the required length and, if necessary, bending into a hairpin shape. In the step at block 102, the plate fins are prepared by suitable processes such as stamping and cutting. Both single row and multiple row plate fins are prepared. In the step at 103, one or more locking members are installed at one end e.g., in a heat exchanger that uses hairpin tubes, at or near the hairpin end. At block 104, the plate fins are stacked in preparation for lacing the tubes through them. A tubesheet may also be prepared and positioned so that it will support the tubes at the end of the heat exchanger that is opposite the end that will have the locking member or members. At block 105, the tubes and plate fins are assembled together by lacing the tubes through the plate fins. The lacing is done so that single row plate fins cover the portions of the tubes on tube rows where there will be relative motion between points on adjacent tube rows during a subsequent bending step. Multiple row plate fins cover the portions of the tubes in all tube rows where there will be no relative motion between points on adjacent tube rows during bending. At block 106, the tubes laced into the plate fin stacks are expanded radially using a suitable expander so that firm mechanical contact is made between the tubes and the locking member(s) and between the tubes and the plate fins and, if one is used, the tubesheet. This step may also include forming belled ends on some or all of the tubes. At block 107, the face of the heat exchanger is bent to the desired curvature. During this step, an end of a given tube row will move with respect to its neighbor, and tube ends in an inner row can be made to engage with the locking member(s) installed in the step described at block 103. In the step described in block 108, the return bends, header nipples or a combination of return bends and header nipples are joined to the tube ends to form one or more closed fluid flow paths through the heat exchanger. At the completion of the work indicated at block 108, the heat exchanger is completed and ready for installation in, for example, an air conditioning system.

I claim:

1. A method of manufacturing a heat
exchanger (10) of the plate fin and tube type, said heat exchanger having
a curved face (11),
multiple rows of tubes (21), with each said row having an end,
a region in which single row plate fins (26) cover said tubes and
a region in which multiple row plate fins (25) cover said tubes,
comprising the steps of:
assembling said tubes and plate fins so that
single row plate fins cover those portions of said tubes where, during a subsequent bending step, points on one said tube row will move relative to points on an adjacent tube row and
multiple row plate fins cover those portions of said tube where, during a subsequent bending step, points on one said tube row will not move relative to points on an adjacent tube row;
placing a row locking member (24) on a tube (21) in a first row of tubes, said locking member having a tube receiver (32) at a predetermined distance from said end;
expanding said tubes; and
bending said tubes to form the desired curve of said curved face heat exchanger and, while bending said tube rows, engaging a tube in a second row of tubes in said tube receiver.

2. A heat exchanger of the plate fin and tube type manufactured according to the method of claim 1.

3. A heat exchanger of the plate fin and tube type, said heat exchanger having
a face that has
a curved portion and
at least one straight portion and
multiple rows of tubes,
comprising:
single row plate fins covering at least the portion of said tube rows that are curved;
multiple row plate fins covering at least one portion of said tubes that are straight; and
a locking member affixed to a tube, by expansion of said tube, in a first tube row and having a receiver that slideably engages an expanded tube in an adjacent tube row.

4. The heat exchanger of claim 3 in which said receiver of said locking member slideably engages at least one pair of said expanded tubes in said adjacent tube row.

* * * * *